US005084684A

United States Patent [19]

Shimizu et al.

[11] Patent Number: 5,084,684

[45] Date of Patent: * Jan. 28, 1992

[54] METHOD OF ADJUSTING A FREQUENCY RESPONSE IN A THREE-CONDUCTOR TYPE FILTER DEVICE

[75] Inventors: Hiroyuki Shimizu; Kenji Ito; Naomasa Wakita, all of Nagoya, Japan

[73] Assignee: NGK Spark Plug Co., Ltd., Japan

[ * ] Notice: The portion of the term of this patent subsequent to Dec. 4, 2007 has been disclaimed.

[21] Appl. No.: 539,711

[22] Filed: Jun. 18, 1990

[30] Foreign Application Priority Data

Aug. 25, 1989 [JP] Japan ..... 1-219580

[51] Int. Cl.[5] ..... H01P 1/203

[52] U.S. Cl. ..... 333/205; 333/204

[58] Field of Search ..... 333/202-205, 333/246, 219

[56] References Cited

U.S. PATENT DOCUMENTS

| | | | |
|---|---|---|---|
| 4,157,517 | 6/1979 | Kneisel et al. | 333/205 |
| 4,266,206 | 5/1981 | Bedard et al. | 333/204 |
| 4,288,530 | 9/1981 | Bedard et al. | 333/205 X |
| 4,609,892 | 9/1986 | Higgins, Jr. | 333/204 |
| 4,916,417 | 4/1990 | Ishikawa et al. | 333/205 X |
| 4,963,843 | 10/1990 | Peckham | 333/204 X |

*Primary Examiner*—Eugene R. Laroche
*Assistant Examiner*—Seung Ham
*Attorney, Agent, or Firm*—Larson and Taylor

[57] ABSTRACT

A method of adjusting a frequency response in a filter device of a three-conductor type having a pair of stacked dielectric substrates with a plurality of stripline resonator conductors being sandwiched therebetween, wherein the frequency adjusting of the filter is performed by partially removing an open circuit end of each resonator conductor and at need by adding an compensating conductor member to the partially removed open circuit end portion of each resonator conductor.

6 Claims, 5 Drawing Sheets

METHOD OF ADJUSTING A FREQUENCY RESPONSE IN A THREE-CONDUCTOR TYPE FILTER DEVICE

BACKGROUND OF THE INVENTION

The present invention relates to a method of adjusting a frequency response in a filter device of three-conductor type which may be used as a band-pass filter for example.

It is known to provide a filter device of three-conductor type which is utilized as a band-pass filter for a microwave range. An example of such a conventional filter device is illustrated in FIGS. 1 and 2. As will be seen in FIGS. 1 and 2, it comprises a lower dielectric substrate 1 and an upper dielectric substrate 2 which are stacked to each other. Each of the dielectric substrates 1 and 2 may be of dielectric ceramic material having a high dielectric constant and a lower dielectric loss such as $BaO\text{-}TiO_2$, $BaO\text{-}TiO_2$-rare earth or the like. The lower dielectric substrate 1 is provided with an external ground conducting layer 3 on the peripheral portion and bottom surface thereof. Similarly, the upper dielectric substrate 2 is provided with an external ground conducting layer 4 on the peripheral portion and upper surface thereof. On the upper surface of the lower dielectric substrate 1 are disposed a plurality of stripline resonator conducting layers 5, 6 and 7 wich form a filter element. Each resonator conducting layer has one end or an open circuit end (5*a*, 6*a* and 7*a* ) spaced from the ground conducting layer 3 and the other end or a short circuit end (5*b*, 6*b* and 7*b*) connected to the ground conducting layer 3. The open circuit ends 5*a*, 6*a* and 7*a* of the respective resonator conducting layers 5, 6 and 7 are alternately disposed so as to form an interdigitated configuration. The upper dielectric substrate 2 is fixed on the lower dielectric substrate 1, and the ground conducting layers 3 and 4 of the respective dielectric substrates are connected to each other.

As well known in the art, the filter device of this type has a frequency response which depends on the configuration and dielectric constant of the substrates, and the dimension of the resonator conductors. Upon the manufacturing of the filter device the dielectric constant of the substrates and the size of the resonator conducting layers are stricly determined. However, it can not be avoided that there may occur any dispertions in the dielectric constant of the substrates and in the dimension of the resonator conducting layers. It is, therefore, necessary to adjust the frequency response of the filter device after being completed.

The adjustment of the frequency response can not be performed by adjusting the length of the resonator conducting layers because they are embedded in the dielectric substrates. One solution to this problem has been proposed in U.S. PAT. No. 4,157,517. According to the adjusting method disclosed in this U.S. patent, the frequency of the filter is previously set at a lower level than a desired one, and the external conductor or ground conducting layer 4 provided on the upper surface of the upper substrate 2 is partially removed at regions 8 adjacent the open circuit ends of the resonator conducting layers 5, 6 and 7 to reduce the capacitance between the external conducting layer 4 and the respective resonator conducting layers and to increase the response frequency of the filter thereby making it possible to adjust the frequency.

However, with this conventional method, when the assembled filter is to be contained in an outer casing 9 after the adjustment of the frequency response is made, the removed regions 8 for the frequency adjustment of the upper surface of the upper dielectric substrate 2 come close to or come into contact with the upper wall of the outer casing 9 because the removed regions 8 are positioned on the upper surface of the upper dielectric substrate 2. Therefore, the stray capacitance may be changed from the adjusted value so that the frequency response may be deviated. For this reason, if the above mentioned adjusting method is applied, the outer casing should be so designed that it has an inner height larger than the height of the filter assembly and the upper surface of the upper dielectric substrate 2 is sufficiently spaced from the upper wall of the casing 9 as will be seen in FIG. 2.

Recently, various equipments or elements adapted for use in a microwave range becomes thinner and it is thus demanded that the filter devices as well as the elements should be constructed in a thinner configuration or dimension.

However, such a demand for a thinner construction cannot be satisfied by utilizing the above mentioned adjusting method in which a casing having a larger inner height is necessarily used.

SUMMARY OF THE INVENTION

It i s therefore an object of the present invention to provide a method of adjusting a frequency response of a filter device of a three-conductor structure type in which there can be compensated any variation in the frequency which may occur when the filter is contained in a casing.

Another object of the invention is to provide a filter device of a three-conductor structure type which fully meets with the requirement for smaller and thinner dimension.

According to one aspect of the present invention, there is provided a method of adjusting a frequency response of a filter device of a three-conductor structure type in which it comprises a pair of dielectric substrates each having an outer surface provided with an external ground conducting layer and opposite lateral surfaces provided with no ground conducting layer, and a plurality of stripline resonator conducting layers sandwiched between said dielectric substrates, each resonator conducting layer having a short circuit end connected to the ground conducting layer on the outer surface of said each substrate and an open circuit end extended to an edge of the associated lateral surface of said each substrate, wherein it comprises the step of partially removing the open circuit end of said each resonator conducting layer and the associated lateral surface of said each substrate at a portion which surrounds the open circuit end of said each resonator conducting layer for tuning the filter device to a desired frequency response.

According to a second aspect of the present invention, there is provided a method of adjusting a frequency response of a filter device of a three-conductor structure type comprising a pair of dielectric substrates each having an outer surface provided with an external ground conducting layer and opposite lateral surfaces provided with no ground conducting layer, and a plurality of stripline resonator conducting layers sandwiched between said dielectric substrates, each resonator conducting layer having a short circuit end connected to the ground conducting layer on the outer surface of said each substrate and an open circuit end extended to an edge of the associated lateral surface of said each substrate, wherein it comprises the steps of partially removing the open circuit end of said each resonator conducting layer and the associated lateral surface of said each substrate at a portion which corresponds to the open circuit end of said each resonator conducting layer for tuning the filter device to a desired frequency response, and connecting an additional conductor member to the open circuit end of said each resonator conducting layer on the lateral surface of said each substrate for compensating any overshoot of the adjustment performed by said first removing step.

In the method of the present invention the open circuit end of said each resonator conducting layer and the associated lateral surface of said each substrate may be partially removed by using a cutting tool, a laser beam machining, a sand blasting or the like. The filter device is constructed to have a resonant frequency lower than an intended frequency before adjusting thereof.

By partially removing the open circuit end of each resonator conducting layer and the associated lateral surface portion of said each substrate which corresponds to the open circuit end of each resonator conducting layer, the length of each resonator conducting layer is shortened and thus a resonant frequency is increased.

Also, by adding the additional conductor member to the removed open circuit end portion of said each resonator conducting layer, it is found that the resonant frequency may be decreased depending on the quantity of the conductor member to be added.

According to a third aspect of the present invention, there is provided a filter device of a three-conductor structure type comprising a pair of dielectric substrates each having a lateral and outer surfaces; an external ground conducting layer provided on the outer surface of said each dielectric substrate; a plurality of stripline resonator conducting layers sandwiched between said dielectric substrates, each resonator conducting layer having a short circuit end connected to said ground conducting layer on the outer surface of said each substrate and an open circuit end extended to an edge of one lateral surface of said each substrate, the open circuit end of said each resonator conducting layer having a portion removed therefrom for increasing a resonant frequency of the filter device; and a casing for containing a filter assembly of said dielectric substrates and said resonator conducting layers, said casing having an inner height equal to the thickness of said filter assembly.

In the filter device of the present invention, the removed open circuit end portion may be provided with an additional conductor member for decreasing a resonant frequency of the filter device.

The present invention will now be described by way of example with reference to the accompanying drawings.

DETAILED DESCRIPTION

Figure 1:
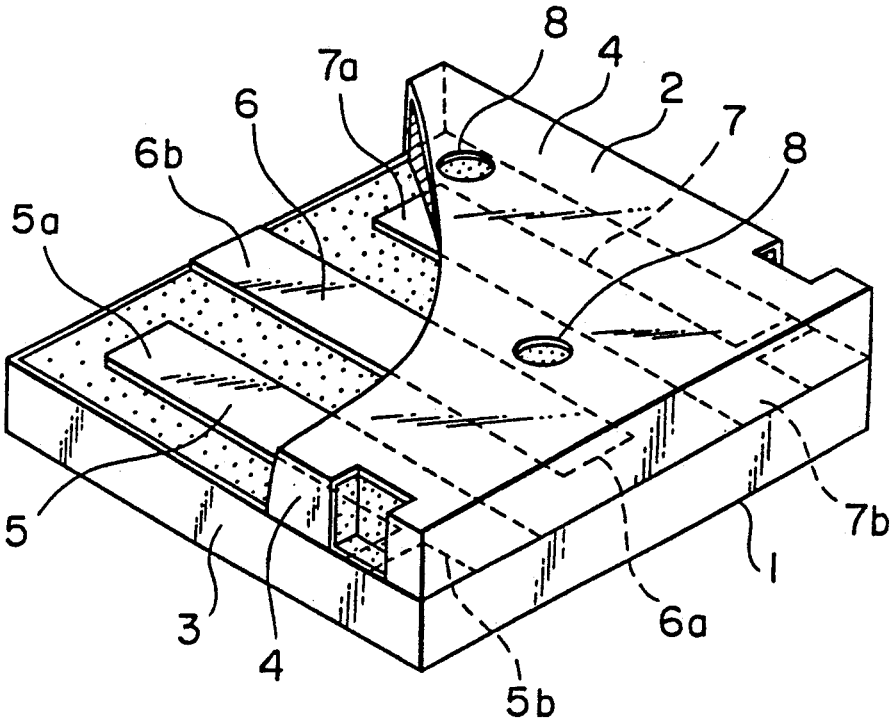
FIG. 1 PRIOR ART
FIG. 1 is a perspective partially cutaway view showing a prior art three-conductor type filter device.
Figure 2:
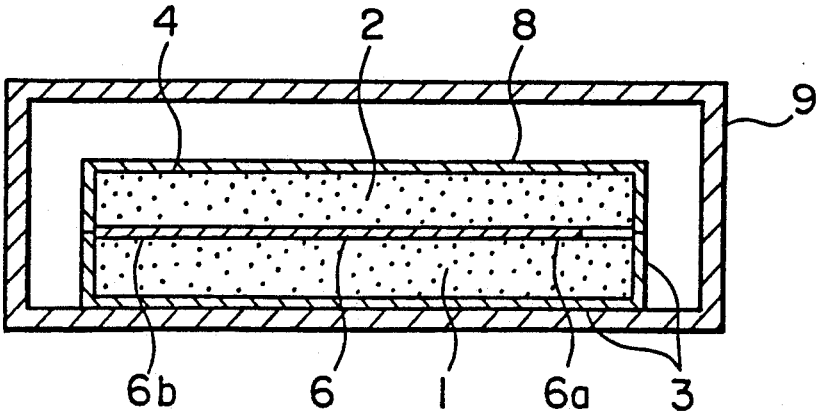
FIG. 2 PRIOR ART
FIG. 2 is a longitudinal section showing the filter device of FIG. 1 contained in a casing.
Figure 3:
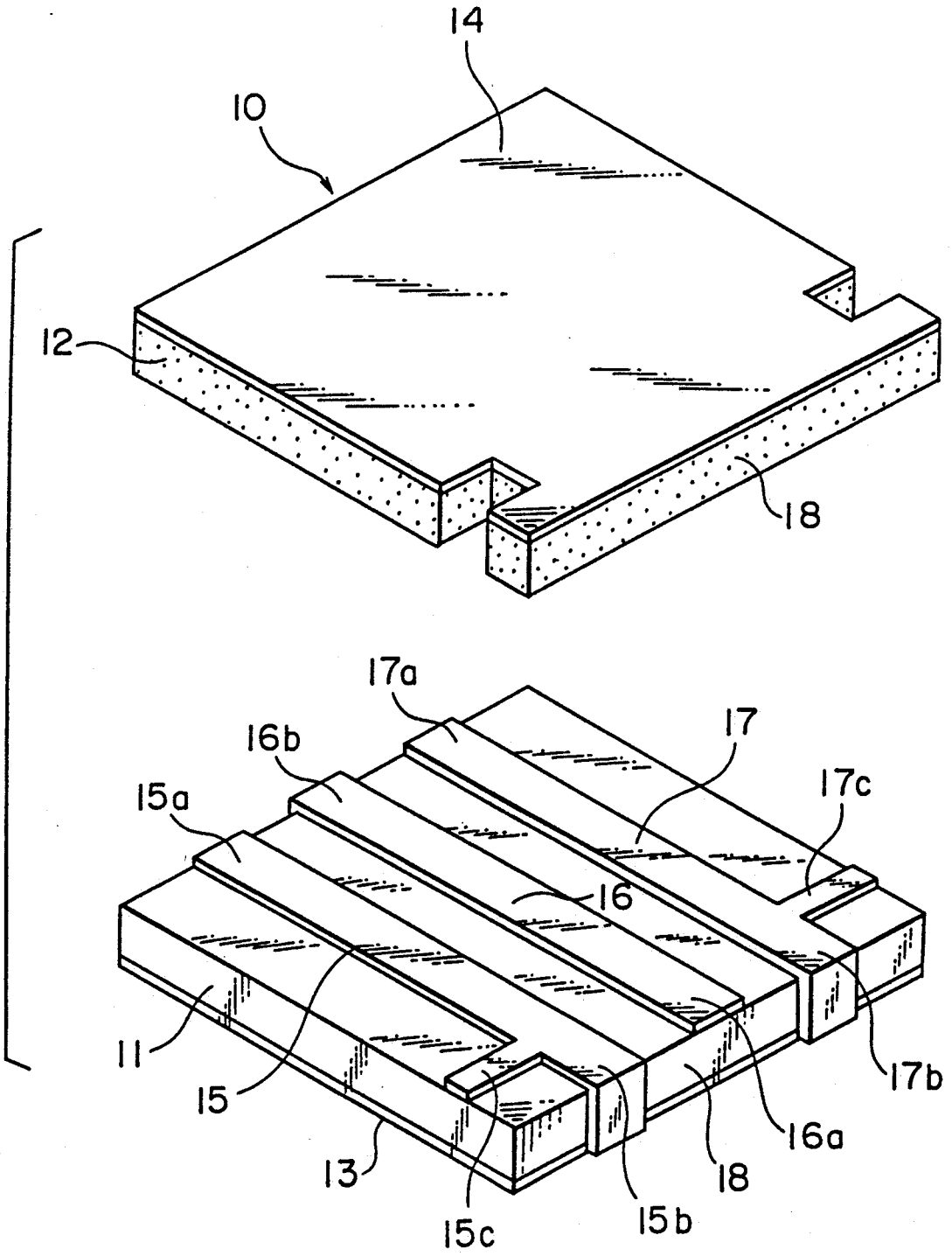
FIG. 3 is an exploded perspective view schematically showing a filter for which the present invention may be applied.

Referring now to FIG. 3, there is shown a three-conductor type filter for which the present invention can be applied.

Figure 7:
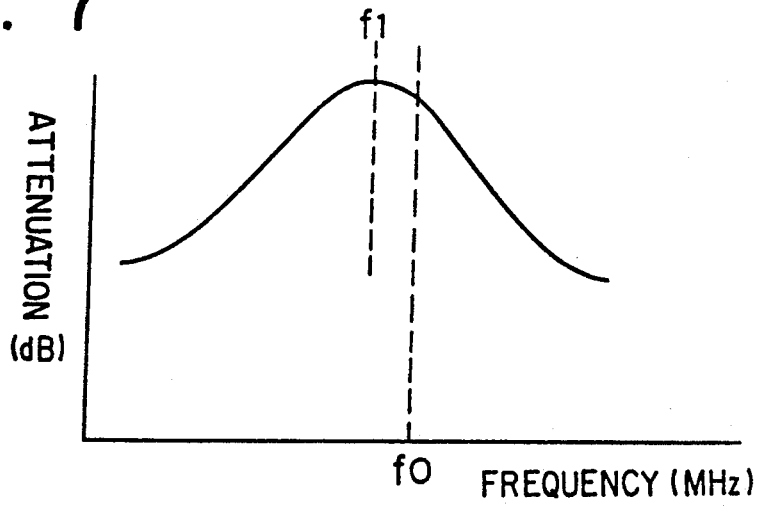
FIGS. 7 and 8 are graphs showing the frequency rsponses of the filter before the frequency adjustment is made.

The illustrated filter 10 comprises a lower and upper dielectric substrates 11 and 12 which are stacked to each other upon the assembling of the filter. Each of the dielectric substrates 11 and 12 may be of dielectric ceramic material having a high dielectric constant and a lower dielectric loss such as $BaO\text{-}TiO_2$, $BaO\text{-}TiO_2$-rare earth or the like. The lower dielectric substrate 11 is provided with a ground conducting layer 13 on the lower or outer surface thereof. Similarly, the upper dielectric substrate 12 is provided with a ground conducting layer 14 on the upper or outer surface thereof. On the upper or inner surface of the lower dielectric substrate 11 are provided a plurality of stripline resonator conducting layers 15, 16 and 17 which form a filter element of an interdigital type. In t his connection, it is substantially unavoidable that there may occur any deviations in the dielectric constants of the used substrates and/or in the dimension of the resonator conducting layers upon the manufacturing, which results in that the frequency response of the completed filter may be deviated from an intended one. Therefore, the dimensions of resonator conducting layers 15, 16 and 17 are determined so that the resonant frequency of the filter becomes slightly lower than the intended one as shown in FIG. 7. Each resonator conducting layer has one or an open circuit end (15*a*, 16*a* and 17*a*) extended to the edge of the lateral surface 18 of the each dielectric substrate and thus spaced from the ground conducting layers 13 and 14 on the outer surface of the respective dielectric substrates 11 and 12. The other end or a short circuit end (15*b*, 16*b* and 17*b*) of each resonator conducting layer is extended across the lateral surface 18 of the lower dielectric substrate 11 and connected to the ground conducting layers 13 and 14 on the outer surface of the respective dielectric substrates 11 and 12. The open circuit ends 15*a*, 16*a* and 17*a* of the respective resonator conducting layers 15, 16 and 17 are alternately disposed so as to form an interdigital type resonator. The upper dielectric substrate 12 is fixed on the lower dielectric substrate 11, and the ground conducting layers 13 and 14 of the respective dielectric substrates are connected to each other through the short circuit ends 15*b*, 16*b* and 17*b* of the respective resonator conducting layers 15, 16 and 17.

The resonator conducting layers 15 and 17 have lateral extensions 15*c* and 17*c*, respectively. One of the lateral extensions 15*c* and 17*c* is connected to a signal input terminal, not shown, and the other extension is connected to a signal output terminal, not shown.

Figure 4:
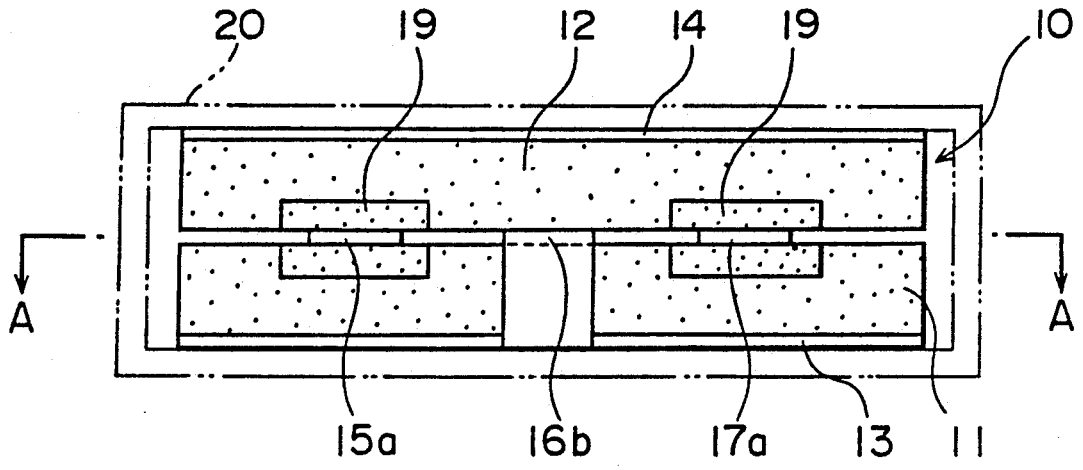
FIG. 4 is a longitudinal section schematically showing a filter device whose frequency response is adjusted in accordance with one embodiment of the present invention.
Figure 5:
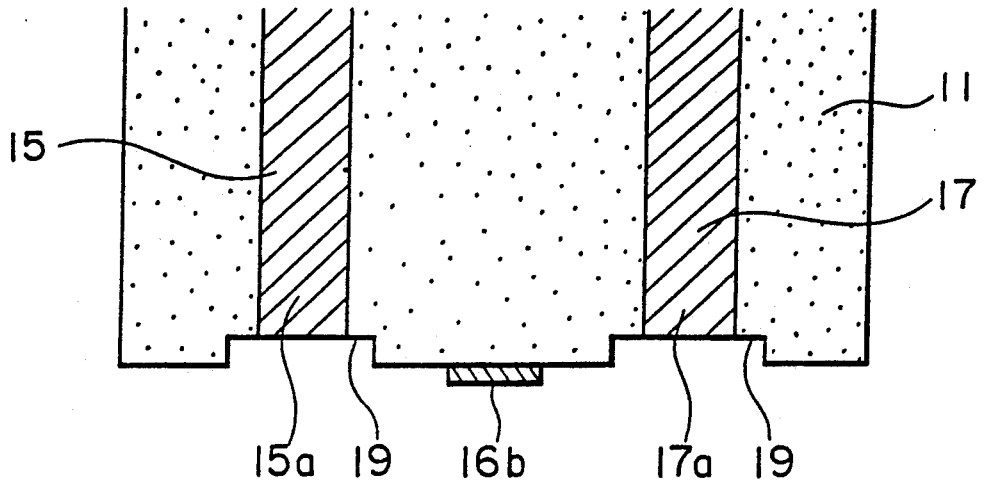
FIG. 5 is a fragmental cross section of the filter device taken along the line A—A of FIG. 4.

With the three-conductor type filter thus constructed, in order to compensate any deviations in the dielectric constants of the used dielectric substrates 11 and 12 and in the length of each resonator conducting layer it is necessary to adjust the frequency of the filter after the dielectric substrates 11 and 12 are assembled with the resonator conducting layers sandwiched therebetween. To this end, as shown in FIGS. 4 and 5, each of the respective resonator conducting layers 15, 16 and 17, and the lateral surface of each substrate are partially removed at each open circuit end portion and the region 19 of the lateral surface of each substrate which surrounds the open circuit end of each resonator conducting layer. In this way, the length of the each resonator conducting layer can be shortened to increase the resonant frequency. This removing operation may be preformed by means of a cutting tool, a laser beam machining, a sand blasting or the like. In this way, the filter can be tuned to a desired frequency response.

Figure 9:
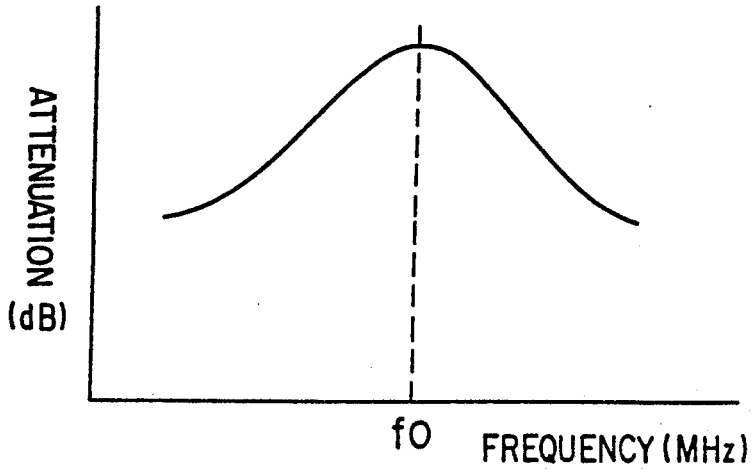
FIG. 9 is a graph showing the frequency response of the filter adjusted in accordance with the present invention.

That is, as shown in FIG. 7, the filter has a center frequency $f_1$ which is slightly lower than a desired response frequency $f_0$ before the frequency adjustment is made. By partially removing the open circuit end portion of each resonator conducting layer to shorten the length of the resonator conducting layer, the center frequency $f_1$ is shifted toward a higher frequency zone so that it becomes identical with the desired response frequency $f_0$ as shown in FIG. 9.

Then, the three-conductor type filter thus adjusted to the desired frequency response is contained in a casing 20 as shown in FIG. 4. The casing 20 may be metal, and has an inner height equal to the height of the filter and a width larger than that of the filter. By selecting the dimension of the casing 20 in this way, the filter device can be constructed without any substantial increasing of the height, and the lateral portions 18 of the filter 10 on which the removed portions 19 are provided can be prevented from bringing into contact with the inner surface of the casing 20. As a result, there can be avoided any variation of stray capacitance which may occur later. In this case, even if the width of the casing 20 is set larger than that of the filter, the requirement for thinner dimension for electronic circuit elements can be effectively satisfied.

FIG. 5 illustrates another embodiment of the present invention in which an additional adjusting means is provided for shifting the center frequency of the filter toward a lower frequency zone.

Figure 6:
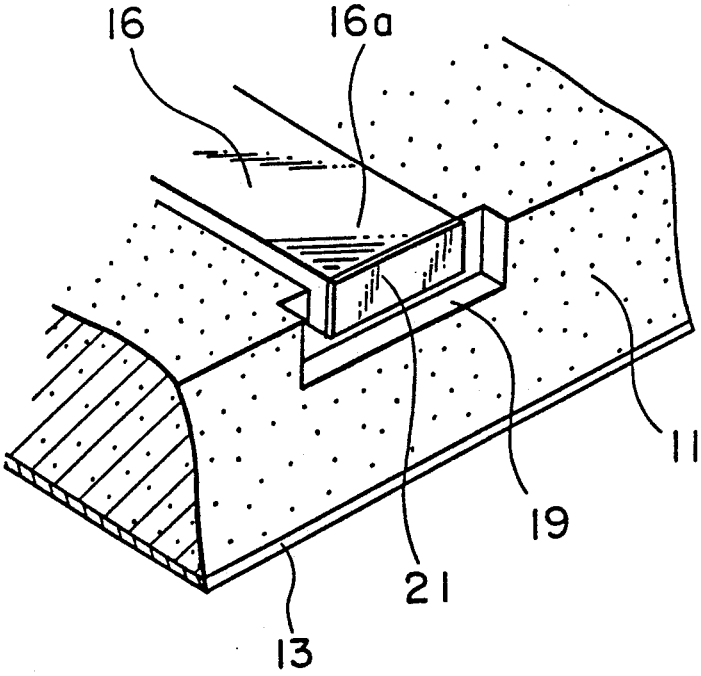
FIG. 6 is a perspective partially cutaway view schematically showing the filter to which additonal conductor member is applied.
Figure 8:
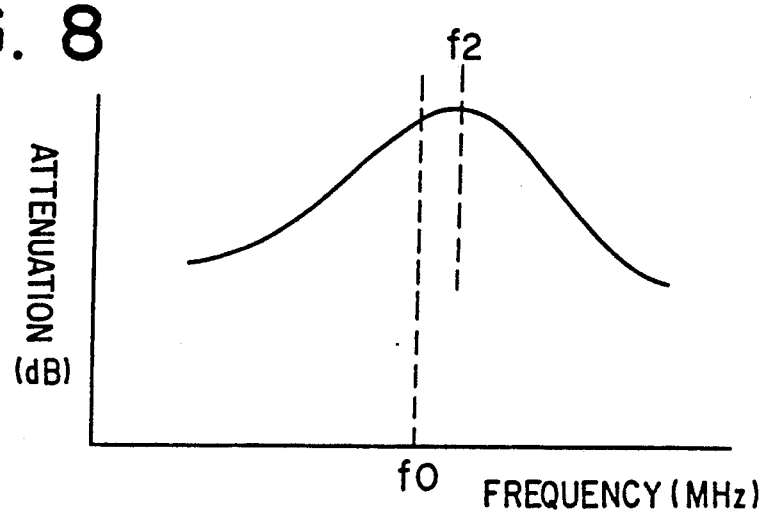

As shown in FIG. 8, there may occur that the center frequency $f_2$ of the filter is shifted over the desired center frequency $f_0$ by the provision of the removed portions 19 on the open circuit ends of the resonator conducting layers 15, 16 and 17 in accordance with the first embodiment of the present invention. In order to compensate this overshoot, as shown in FIG. 6, an additional conductor strip 21 is provided on the open circuit end portion of each of the resonator conducting layers 15, 16 and 17 at the partially removed portions 19. This additional conductor strip 21 may be formed by means of any suitable method. Therefore, each resonator conducting layer is lenghtened, so that the center frequency $f_2$ is shifted toward a lower frequency zone so that it becomes identical with the desired response frequency $f_0$ as shown in FIG. 9.

With the illustrated embodiments shown in FIGS. 3 to 6, the upper dielectric substrate 12 may also be provided with a transmission line pattern of resonator conducting layers on the lower surface, which is disposed to have a reflected image relation with respect to the stripline pattern of the resonator conducting layers 15, 16 and 17 on the lower dielectric substrate 11. When being assembled the stripline pattern on the lower dielectric substrate 11 comes into face-to-face contact with the transmission line pattern on the upper dielectric substrate 12 without occurring any gaps between the lower dielectric substrate 11 and the upper dielectric substrate 12.

Further, the stripline pattern of the resonator conducting layers 15, 16 and 17 may be formed as a comb type in which the open circuit ends and the short circuit ends thereof are disposed at the same sides, respectively.

As described above, according to the present invention the frequency adjusting of the filter is performed by partially removing the open circuit end of each resonator conductor and the regions of the lateral surfaces of each substrate surrounding each open circuit end, and at need by adding an compensating conductor member to the partially removed open circuit end portion of each resonator conductor. Therefore, since the outer conductor of the filter is not removed at regions which are to be abutted on the inner surface of a casing as in the case of the conventional filter device, the present invention has an advantage that there is no variation or deviation in the set frequency characteristic of the filter when the filter device is completed by inserting the filter into the casing. The present invention has also an advantage that a frequency adjustment can be correctly made without increasing the thickness or height of the casing.

Furthermore, by adjusting the length of the respective resonator conducting layer there can be obtained an advantage that the range of adjustment may be widened thereby making it easy to correct the frequency response of the filter device.

It is to be understood that the present invention is not limited to the particular embodiments described and that numerous modifications and alterations may be made by those skilled in the art without departing from the spirit and scope of the invention.

What is claimed is:

1. A method of adjusting the frequency response of a filter device of a three-conductor structure type comprising a pair of dielectric substrates each having an outer surface provided with an external ground conducting layer and opposite lateral surfaces provided with no ground conducting layer, and a plurality of stripline resonator conducting layers sandwiched between said dielectric substrates, each resonator conducting layer having a short circuit end connected to the ground conducting layer on the outer surface of said each substrate and an open circuit end extended to an edge of the associated lateral surface of said each substrate, wherein the method comprises the step of partially removing the open circuit end of said each resonator conducting layer and the associated lateral surface of said each substrate at a portion which surrounds the open circuit end of said each resonator conducting layer so as to tune the filter device to a desired frequency response.

2. A method as claimed in claim 1, wherein said removing step is performed by using a cutting tool, laser beam machining, or sand blasting.

3. A method of adjusting the frequency response of a filter device of a three-conductor structure type comprising a pair of dielectric substrates each having an outer surface provided with an external ground conducting layer and opposite lateral surfaces provided with no ground conducting layer, and a plurality of stripline resonator conducting layers sandwiched between said dielectric substrates, each resonator conducting layer having a short circuit end connected to the ground conducting layer on the outer surface of said each substrate and an open circuit end extended to an edge of the associated lateral surface of said each substrate, wherein said method comprises a first step of partially removing the open circuit end of said each resonator conducting layer and the associated lateral surface of said each substrate at a portion which surrounds the open circuit end of said each resonator conducting layer so as to provide tuning of the filter device to a desired frequency response, and a further step of providing an additional conductor member to the open circuit end of said each resonator conducting layer on the lateral surface of said each substrate so as to compensate for any overshoot of the adjustment performed by said first step.

4. A method as claimed in claim 3, wherein said each removing step is performed by using a cutting tool, laser beam machining, or sand blasting.

5. A filter device of a three-conductor structure type comprising a pair of dielectric substrates each having a lateral and outer surfaces; an external ground conducting layer provided on the outer surface of said each dielectric substrate; a plurality of stripline resonator conducting layers sandwhiched between said dielectric substrates, each resonator conducting layer having a short circuit end connected to said ground conducting layer on the outer surface of said each substrate and an open circuit end extended to an edge of one lateral surface of said each substrate, the open circuit end of said each resonator conducting layer having a portion removed therefrom so as to increase the resonant frequency of the filter device; and a casing for containing a filter assembly of said dielectric substrates and said resonator conducting layers, said casing having an inner height equal to the thickness of said filter assembly.

6. A filter device as claimed in claim 5, wherein the open circuit end of said each resonator conducting layer is provided with an additional conductor member for decreasing a resonant frequency of the filter device.

* * * * *